US005806757A

United States Patent [19]

Per et al.

[11] Patent Number: 5,806,757

[45] Date of Patent: Sep. 15, 1998

[54] DEVICE FOR UNSEALING POUR OPENING OF LIQUID CONTAINER

[75] Inventors: Ohlsson Per, Tokyo, Japan; Mock Elmar, Biel, Switzerland; Hylta Patrik, Tokyo, Japan

[73] Assignee: Tetra Laval Holdings & Finance S.A., Pully, Switzerland

[21] Appl. No.: 750,100

[22] PCT Filed: May 31, 1995

[86] PCT No.: PCT/JP95/01060

§ 371 Date: Feb. 28, 1997

§ 102(e) Date: Feb. 28, 1997

[87] PCT Pub. No.: WO95/33656

PCT Pub. Date: Dec. 14, 1995

[30] Foreign Application Priority Data

Jun. 2, 1994 [JP] Japan ..... 6-145494

[51] Int. Cl.[6] ..... B65D 17/30

[52] U.S. Cl. ..... 229/204; 220/269; 229/229; 229/238

[58] Field of Search ..... 229/123.2, 123.3, 229/200, 221, 222, 125.01, 125.08, 204, 229, 238, 125.09; 222/541.5, 541.6, 541.7, 81, 556, 508, 83; 220/268, 269

[56] References Cited

U.S. PATENT DOCUMENTS

| | | | |
|---|---|---|---|
| 3,301,434 | 1/1967 | Harvey et al. | 220/269 X |
| 3,952,912 | 4/1976 | Perry | 220/268 |
| 3,967,750 | 7/1976 | Cudzik | 220/269 X |
| 3,977,591 | 8/1976 | Martensson et al. | 229/125.09 |
| 3,981,411 | 9/1976 | Hofstetter | 220/268 X |
| 4,210,257 | 7/1980 | Radtke | 220/269 |
| 4,480,763 | 11/1984 | Schneider | 220/269 |
| 4,553,684 | 11/1985 | Bennett | 220/268 |
| 4,838,428 | 6/1989 | Rausing . | |
| 4,913,294 | 4/1990 | Giacomelli | 229/204 |
| 5,147,057 | 9/1992 | Marshall et al. | 220/268 |
| 5,655,678 | 8/1997 | Kobayashi | 220/269 |

FOREIGN PATENT DOCUMENTS

| | | |
|---|---|---|
| 58-3436 | 1/1983 | Japan . |
| 58-145847 | 9/1983 | Japan . |
| 58-67776 | 9/1983 | Japan . |

*Primary Examiner*—Allan N. Shoap
*Assistant Examiner*—Tri M. Mai
*Attorney, Agent, or Firm*—Loeb & Loeb LLP

[57] ABSTRACT

Provided is a device, made of a resion material, for unsealing a pour opening of a liquid container, which comprises: an unsealing portion 11 for unsealing a sealing member, an actuating portion 12 for actuating the unsealing portion 11, and a support portion 13 for so supporting the actuating portion 12 that the pour opening unsealing device 10 is secured to the liquid container, wherein the unsealing portion 11, the actuating portion 12 and the support portion 13 are disposed across the same plane; wherein the opening portion 11 and the actuating portion 12 are connected at a lower portion of a V-shaped groove 14, which is formed between facing end of the unsealing portion 11 and the actuating portion 12, by a thin-walled portion 14*a*; wherein the support portion 13 is positioned so as to encompass the unsealing portion 11 and a predetermined portion of the actuating portion 12, which is a continuation of the unsealing portion 11; wherein the actuating portion is supported by support bar members 15 having a predetermined length, which are provided on both sides a specified distance from the V-shaped groove 14, and pivots at the support portion 13; and wherein when one end of the actuating portion 12 that is farthest from the unsealing portion 11 is raised, the other end of the actuating portion 12 nearest the unsealing portion 11 pivots around the support bar members 15, and accordingly, the unsealing portion 11 is pivoted at the thin-walled portion 14*a* to unseal a sealing member that is located under the unsealing portion 11.

5 Claims, 8 Drawing Sheets

DEVICE FOR UNSEALING POUR OPENING OF LIQUID CONTAINER

FIELD OF THE INVENTION

The present invention relates to a device, for unsealing a pour opening of a liquid container, that is located over a sealing member, such as a film-shaped sheet, for covering and sealing the pour opening of a liquid container that is formed of packaging web made mainly of paper or plastic material, and that opens the sealing member. In particular, the present invention pertains to a device, for unsealing a pour opening, that is appropriate for unsealing a pour opening, of a so-called non-resealable liquid container, that, once opened, is not sealed again.

BACKGROUND OF THE INVENTION

A pour opening of a liquid container that is formed of packaging web consisting mainly of paper or plastic material is sealed with a film-shaped sheet or a resin pull-tab. To unseal the pour opening, the sheet or the pull-tab is torn off, or the sheet is pierced with a drinking straw. However, the disadvantage of the opening methods that involve the tearing off of sheets and pull-tabs or the piercing of sheets with drinking straws is that the sheets or the pull-tabs and the drinking straws become another source of refuse when separated from liquid containers, and if they are discarded carelessly, can constitute a trash disposal problem.

Conventional arrangements have been devised with which only a part of a sheet or of a pull-tab is torn loose, and the unsealed sheet or pull-tab remains attached to the liquid container. With these arrangements, however, the problem is that when a user releases the sheet or the pull-tab that has been torn loose, it returns and closes the pour opening of the liquid container. One type of liquid container that is made of a metallic material, such as aluminum, has a pour opening so structured that once the pour opening is unsealed, the unsealed condition is maintained. However, none of the liquid containers that are formed mainly of paper or a plastic material have a pour opening that is so structured. Therefore, there is a demand for the development of such a structure.

To overcome the above described problems, it is one object of the present invention to provide a device for unsealing a pour opening of a liquid container, which is formed mainly of paper or a plastic material, that is so designed that once a pour opening is unsealed, it does not close again, even if a user releases the unsealed portion.

DISCLOSURE OF THE INVENTION

According to the present invention, provided is a device for unsealing a pour opening, of a liquid container, that is located atop a sealing member, such as a film-shaped sheet, for covering and sealing the pour opening of a liquid container that is formed of packaging web made mainly of paper or plastic material, and that opens the sealing member. As is shown in FIG. 1A, a pour opening unsealing device 10, which is made of a resin material, comprises:

an unsealing portion 11 for unsealing a sealing member;

an actuating portion 12 for actuating the unsealing portion 11; and a support portion 13 for so supporting the actuating portion 12 that the pour opening unsealing device 10 is secured to the liquid container. The unsealing portion 11, the actuating portion 12 and the support portion 13 are disposed across the same plane. The opening portion 11 and the actuating portion 12 are connected at a lower portion of a V-shaped groove 14, which is formed between facing end of the unsealing portion 11 and the actuating portion 12, by a thin-walled portion 14*a*. The support portion 13 is positioned so as to encompass the unsealing portion 11 and a predetermined portion of the actuating portion 12, which is a continuation of the unsealing portion 11. The actuating portion is supported by support bar members 15 having a predetermined length, which are provided on both sides a specified distance from the V-shaped groove 14, and pivots at the support portion 13. When one end of the actuating portion 12 that is farthest from the unsealing portion 11 is raised, the other end of the actuating portion 12 nearest the unsealing portion 11 pivots around the support bar members 15, and accordingly, the unsealing portion 11 is pivoted at the thin-walled portion 14*a* to unseal a sealing member that is located under the unsealing portion 11.

Referring now also to FIG. 1B, FIG. 1C and FIG. 1D before "An" and please change "An" to an; an engagement step 11*a* that is located at an end of the unsealing portion 11 farthest from the actuating portion 12 engages an engagement step 13*a* of the support portion 13, and the support bar members 15 are inclined at a specified angle downward relative to the unsealing portion 11. When the end of the actuating portion 12 that is farthest from the unsealing portion 11 is raised, the end of the actuating portion 12 nearest the unsealing portion 11 pivots at the support bar members 15. The engagement step 11*a* of the unsealing portion 11 is disengaged from the engagement step 13*a* of the support member, and accordingly, the unsealing portion 11 is pivoted at the thin-walled portion 14*a*. As a result, the sealing member that is positioned on a lower side of the unsealing portion 11 is ripped off.

Referring now also to FIG. 2A and to FIG. 2B engagement pieces 16 are formed on both sides at the end of the unsealing portion 11 nearest the actuating portion 12. When the unsealing portion 11 is pivoted downward at the thin-walled portion 14*a*, the engagement pieces engage collar portions 13*b* on the side portions of the support member 13, and when the actuating portion 12 is returned to an original position, the engagement pieces hold the unsealing portion 11 at the original position.

With the thus described structure of the present invention, when the end of the actuating portion 12 that is farthest from the unsealing portion 11 is raised, the thin-walled portion 14*a* that connects the actuating portion 12 and the unsealing portion 11 is pivoted at a support point G on the side of the support member 13 at the support bar member 15, in at least one of an upward and downward direction relative to a central axis of the present invention as illustrated in FIG. 3. Accordingly, the thin-walled portion 14*a* is bent, causing the unsealing portion 11 to be pulled toward the actuating portion 12. As the thin-walled portion 14*a* is pivoted farther, the unsealing portion 11 is moved downward. In other words, the end of the sealing portion 11 that is farthest from the actuating portion 12 is moved downward. As a result, a sealing member, such as a film-shaped sheet, which seals a pour opening that is disposed below the lower side of the unsealing portion 11, is ripped off.

First, as the unsealing portion 11 is pulled toward the actuating portion 12, the engagement step 11*a* of the unsealing portion 11 is disengaged from the engagement step 13*a* of the support portion 13, and then the unsealing portion 11 is pivoted downward at the thin-walled portion 14*a*. In this manner, when the end of the actuating portion 12 is raised, a force acting on the actuating portion 12 causes the unsealing portion 11 to be pushed in a direction opposite to the movement of the actuating portion 12, and thus drives the unsealing portion 11. At this time, with the support bar member 15 being so provided that it inclines at a predetermined angle downward relative to the unsealing portion 11, the pushing force exerted by the unsealing portion 11 is halted by the support bar member 15. In addition, since the support point H, for the support bar member 15, that is near the actuating portion 12 is positioned diagonally downward and away from the support point G and near the support portion 13, the end of the unsealing portion 11 farthest from the actuating portion 12 is moved smoothly, as the thin-walled portion 14*a* is bent.

As is described above, by raising the end of the actuating portion 12 only slightly, the engagement step 11*a* of the unsealing portion 11 is disengaged from the engagement step 13*a* of the support portion 13, so that it is easily determined whether or not a third person has for some reason raised the actuating portion 12. Therefore, it is easy to detect when a third person has, for example, used a pour opening to mix a noxious substance into the original contents after a liquid container has been filled and sealed.

Since the engagement pieces 16 are formed at both sides at the end of the unsealing portion 11 nearest the actuating portion 12, as the rotation of the unsealing portion 11 is continued to invert it, the engagement pieces 16 descend past the collar portions 13*b*, which are located on the sides of the support portion 13. When the actuating portion 12 is returned to its original position, the engagement pieces 16 engage the collar portions 13*b* and prevent the unsealing portion 11 from returning to its original position. Thus, as is shown in FIG. 4, an opening K is maintained at the pour opening of the liquid container.

BRIEF DESCRIPTION OF THE DRAWINGS

FIG. 1 is a plan view of the structure of a pour opening unsealing device for a liquid container according to the present invention.

BEST MODES FOR CARRYING OUT THE INVENTION

Figure 1A:
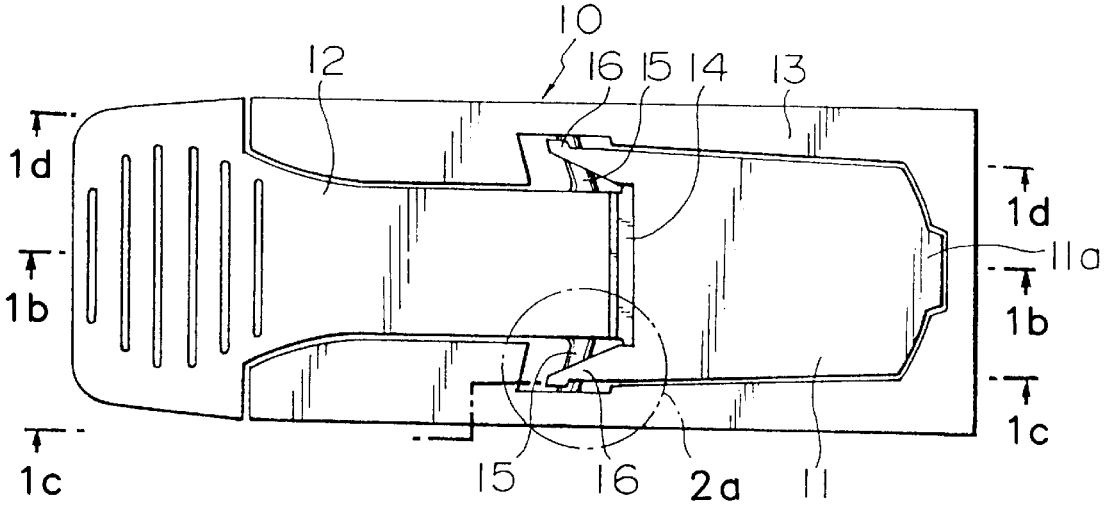
FIG. 1A is plan view.
Figure 1B:
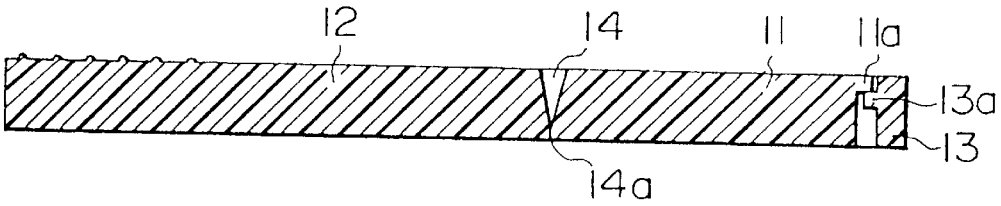
FIG. 1B is a cross sectional view taken along line 1(*b*)—1(*b*).
Figure 1C:
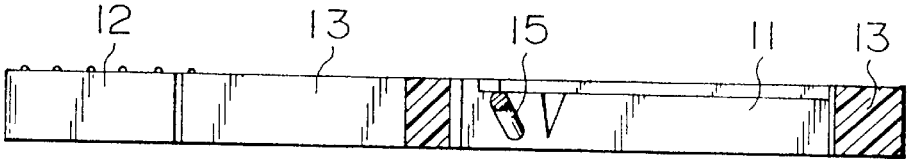
FIG. 1C is a cross sectional view taken along line 1(*c*)—1(*c*).
Figure 1D:
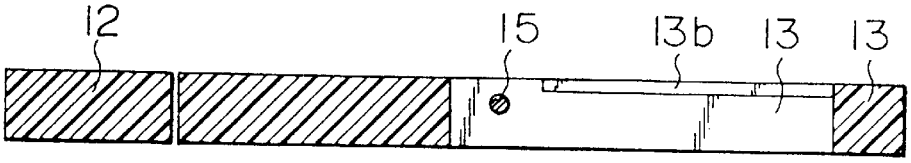
FIG. 1D is a cross sectional view taken along line A—A.

Embodiments of the present invention will now be described while referring to the drawings. It is noted that the references to the Figures, which have been defined above, are interchangeably designated with parentheses below—for example—FIG. 1A is likewise referenced as FIG. 1(*a*). FIG. 1 is a plan view of the structure of a pour opening unsealing device for a liquid container according to the present invention, with (a) being a plan view, (b) being a cross-sectional view taken along line 1(*b*)—1(*b*), (c) being a cross-sectional view taken along line 1(*c*)—1(*c*), and (d) being a cross-sectional view taken along line 1(*d*)—1(*d*).

As is shown in FIG. 1, a pour opening unsealing device 10, which is formed of a resin material plate, comprises an unsealing portion 11, for unsealing a sealing member, such as a film-shaped sheet, that seals the pour opening of a liquid container; an actuating portion 12, for actuating (manipulating) the unsealing portion 11; and a support portion 13, for supporting the actuating portion 12 so as to secure the pour opening unsealing device in the vicinity of the pour opening of the liquid container.

As is illustrated, the unsealing portion 11, the actuating portion 12, and the support portion 13 are located along the same plane. The unsealing portion 11 and the actuating portion 13 are contiguous, being connected at the lower portion of a V-shaped portion 14, which is formed between the opposing ends of the unsealing portion 11 and the actuating portion 13, by a thin-walled portion 14*a*. The support portion 13 is so positioned that it encloses the unsealing portion 11 and a predetermined area of the contiguous actuating portion 12. The actuating portion 12 is supported by support bar members 15 having a predetermined length, which are provided on both sides a specified distance from the V-shaped groove 14, and is pivoted relative to the support portion 13.

Figure 2A:
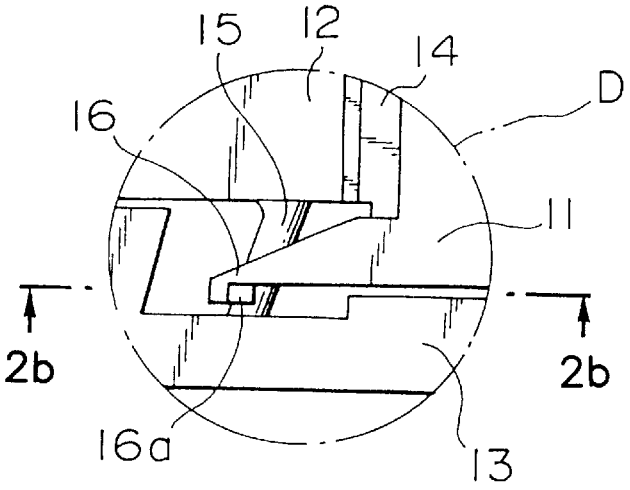
FIG. 2A is an enlarged diagram illustrating portion 2(*a*) in FIG. 1(*a*).
Figure 2B:
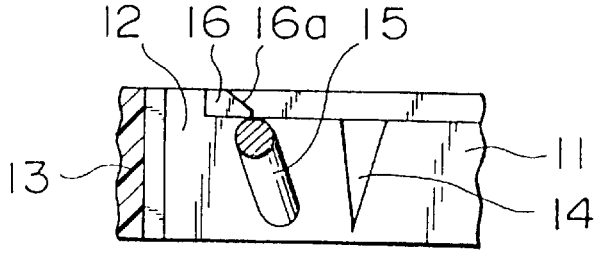
FIG. 2B is a cross-sectional view taken along line 2(*b*)—2(*b*)

FIG. 2(*a*) is an enlarged diagram showing portion 2(*a*) in FIG. 1(*a*), and FIG. 2(*b*) is a cross-sectional view taken along line 2(*b*)—2(*b*). As is shown, one end of each support bar member 15 is coupled with the support portion 13, and the other end is inclined downward at a predetermined angle toward the actuating portion 12 and coupled with the actuating portion 12. Engagement pieces 16 are formed at both sides at the end of the unsealing portion 11 nearest the actuating portion 12. The distal ends of the engagement pieces 16 have inclined surfaces 16*a*. As will be described later, the inclined surfaces 16*a* enable the engagement pieces 16 to smoothly move across collar portions 13*b* of the support portion 13 when the unsealing portion 11 is pivoted. Therefore, the inclined surfaces 16*a* are not always required.

As is shown in FIG. 1(*a*) and (*b*), an engagement step 11*a* is formed at the distal end (the end away from the actuating portion 12) of the unsealing portion 11. An engagement step 13*a* is formed at a corresponding position on the support portion 13 to engage the engagement step 11*a*. The thin-walled collar portions 13*b* are formed on the sides of the support portion 13 that are opposite the two sides of the unsealing portion 11, as is shown in FIG. 1(*d*).

Figure 5:
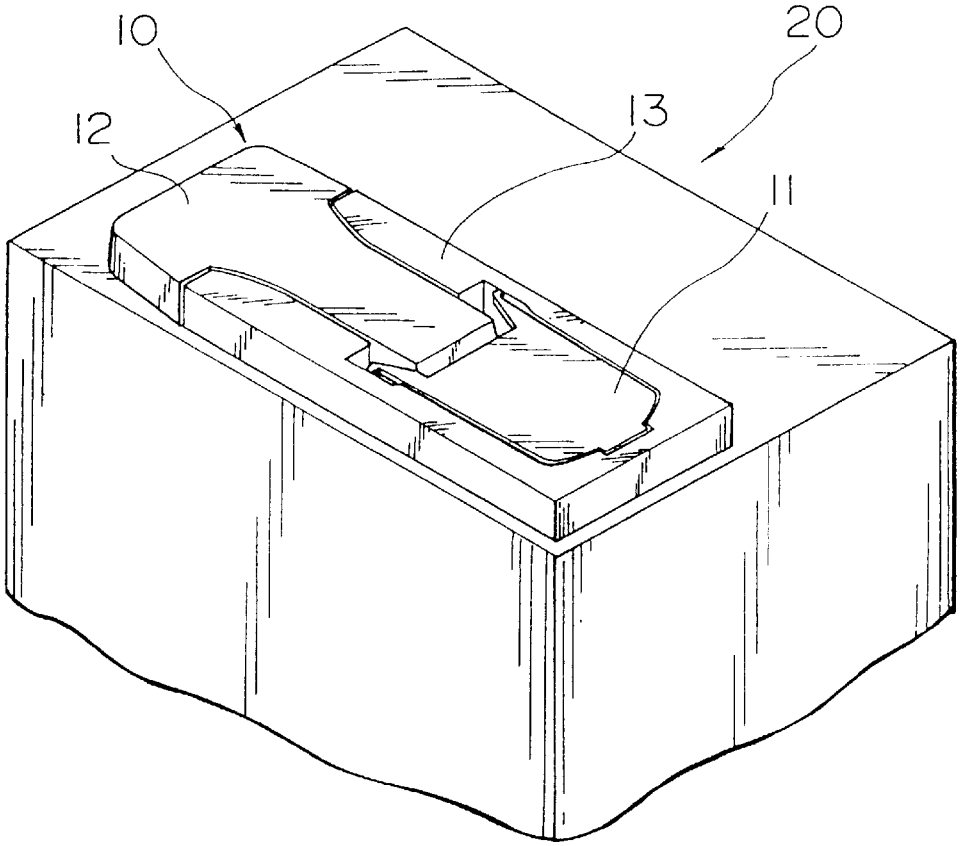
FIG. 5 is a diagram illustrating an external appearance when the pour opening unsealing device of the present invention is attached to the pour opening of a liquid container.
Figure 6A:
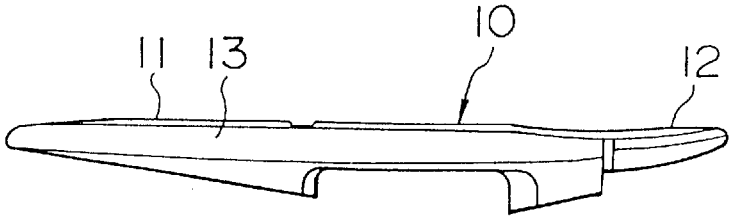
FIG. 6A is a side view of the structure of another pour opening unsealing device for a liquid container according to the present invention.
Figure 6B:
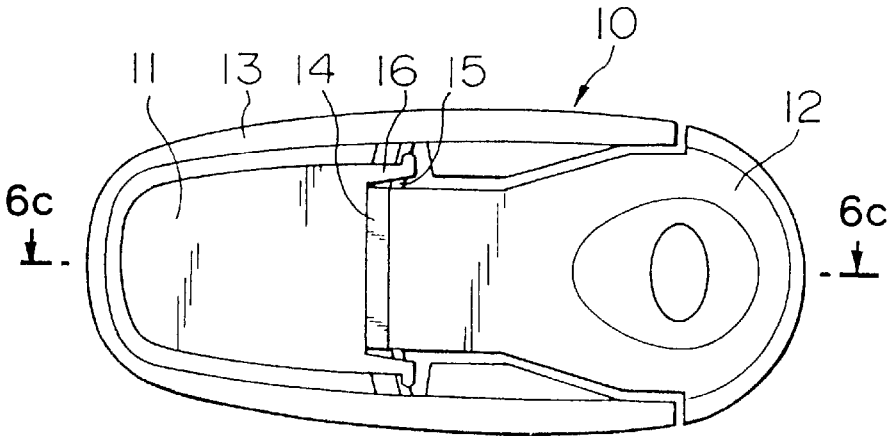
FIG. 6B is a plan view.
Figure 6C:
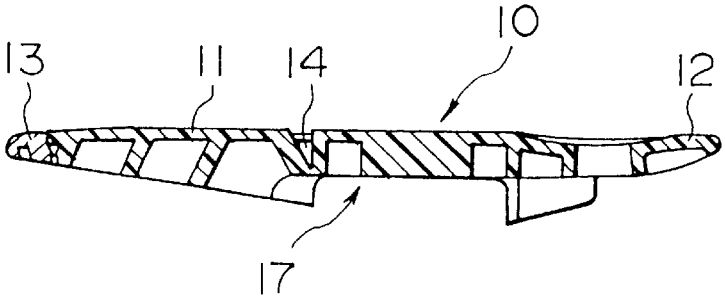
FIG. 6C is a cross-sectional view taken along line 6(*c*)—6(*c*).
Figure 6D:
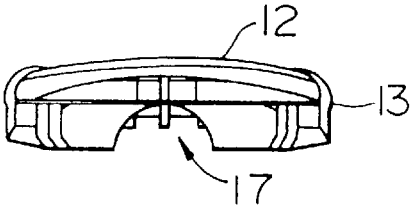
FIG. 6D is a right side view according to this embodiment of the present invention.

The thus structured pour opening unsealing device 10 is so positioned and secured over the pour opening (not shown) of a liquid container 20, which is formed mainly of paper or a plastic material, as is shown in FIG. 5, that the unsealing portion 11 is located above a sealing member, such as a film-shaped sheet, that seals the pour opening. When the actuating portion 12 is pulled up, the unsealing portion 11 is rotated downward and tears the sealing member, thereby unsealing the pour opening. The operation of the pour opening unsealing device 10 will now be described.

Figure 3:
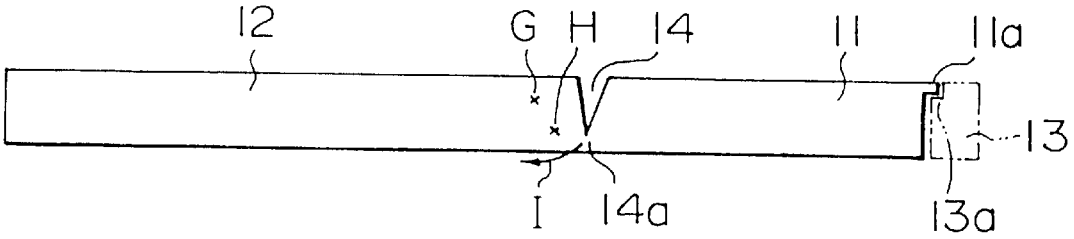
FIG. 3 is a diagram for explaining the operation of the pour opening unsealing device for a liquid container according to the present invention.

FIG. 3 is a diagram for explaining the operation of the pour opening unsealing device 10. In this diagram, G denotes each of the support points (the centers of the connection between the support bar member 15 and the support portion 13) for the support bar members 15 at the support member 13, and H denotes each of the support points (the centers of the connection between the support bar member 15 and the actuating portion 12) for the support bar member 15 at the actuating portion 12.

When the rear end (the end farthest from the unsealing portion 11) of the actuating portion 12 is raised, the thin-walled portion 14*a* that connects the unsealing portion 11 and the actuating portion 12 pivots at the support point G, as is indicated by arrow I. Consequently, the thin-walled portion 14*a* is bent, causing the unsealing portion 11 to be pulled toward the actuating portion 12. When the unsealing portion 11 is pulled toward the actuating portion 12, and the engagement step 11*a* of the unsealing portion 11 is disengaged from the engagement step 13*a* of the support portion 13, at the V-shaped groove 14, the above-described pulling force and the bending of the thin-walled portion 14*a* brings the side of the actuating portion 12 into contact with the side of the unsealing portion 11, so that it pushes against the unsealing portion 11. Thereafter, the unsealing portion 11 pivots at the support point G, and its distal end (the farthest from the actuating portion 12) is moved downward.

As the unsealing portion 11 is moved, the sealing member that is disposed beneath the unsealing portion 11 for sealing the pour opening is torn off, and the pour opening is unsealed. As the unsealing portion 11 is pivoted farther, it is rotated downward. In other words, the end of the unsealing portion 11 remote from the actuating portion is rotated downward. In this manner, the sealing member that is located beneath the unsealing portion 11 for sealing the pour opening is torn, and the pour opening is unsealed.

As the rotation of the unsealing portion 11 is continued until it is inverted (where the bottom face is directed upward), the engagement pieces 16 descend past the collar portions 13*b* of the support portion 13. In other words, since the engagement pieces 16 are made of a flexible resin material, are tapered and have thin walls, they are moved past the collar portions 13*b* and down by the rotational force exerted by the actuating portion 12. At this time, since each engagement piece 16 has an inclined surface 16*a* on the side of its distal end, it can easily move past the collar portion 13*b*.

Figure 4:
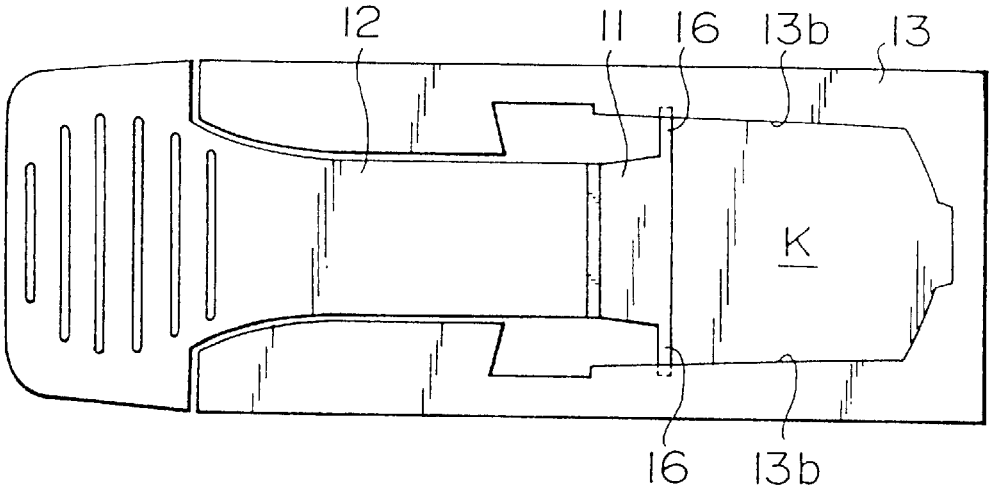
FIG. 4 is a plan view of the unsealed state of the pour opening unsealing device for a liquid container according to the present invention.

If, in this state, the actuating portion 12 is returned to the position it occupied before the pulling operation was begun, the unsealing portion 11 is also shifted back toward the position where it closes the opening. However, as is shown in FIG. 4, the distal end portions of the engagement pieces 16 are arrested by the collar portions 13*b* of the support portion 13, so that the unsealing portion 11 can not be returned to its former position and is held in this position. Thus, the opening K, which has approximately the same shape as that of the unsealing portion 11, is maintained at the pour opening of the liquid container.

Since the force employed for pushing the unsealing portion 11 is applied to the actuating portion 12 by pulling the rear end of the actuating portion 12, it is sometimes difficult for the engagement step 11*a* of the unsealing portion 11 to be disengaged from the engagement step 13*a* of the support portion 13. To cope with this problem, in this embodiment the support bar members 15 are so located that they incline downward at a predetermined angle toward the sides of the unsealing portion 11. The need to exert excessive force to push the unsealing portion 11 is therefore effectively avoided. Further, since the support points H of the support bar members 15 are located diagonally downward away from the support point G, in consonance with the bending of the thin-walled portion 14*a*, the distal end (the end farthest from the actuating portion 12) of the unsealing portion 11 moves smoothly.

The disengagement of the engagement step 11*a* of the unsealing portion 11 from the engagement step 13*a* of the support portion 13 is also effected by slightly raising the end (the end farthest from the unsealing portion 11) of the actuating portion 12. After being disengaged, since the engagement step 11*a* is held on the lower surface of the engagement step 13*a*, this condition can be easily detected from the external appearance. Therefore, even if, for example, a third person uses a pour opening to introduce a noxious substance into the original contents of a liquid container that has been filled and sealed, this can be easily detected.

The shapes and locations of the unsealing portion 11, the actuating portion 12 and the support portion 13 are not limited to those in this embodiment. Their shapes and locations may be varied so long as the unsealing portion, the actuating portion and the support portion that are formed of a resin material are located on the same plane; the unsealing portion and the actuating portion are connected at the base of a V-shaped groove, which is formed in the facing ends of these components, by a thin-walled portion; and the support portion is so positioned that it encloses the unsealing portion and a contiguous, predetermined portion of the actuating portion.

In this embodiment, an explanation has been given for the example whereof the film-shaped sheet that covers the pour opening of a liquid container is torn off by the unsealing portion 11. The sealing member that covers the pour opening is not limited to the film-shaped sheet, and a plate cap that has the same shape as that of the pour opening, for example, may be used to seal the gap between its perimeter and the pour opening, or a small groove may be formed in the material at a position for a pour opening on a liquid container that can be easily perforated to provide a pour opening. In short, it is obvious that any sealing member can be used that can be easily unsealed by the descending unsealing portion 11 and that functions to provide a good seal.

Figure 7:
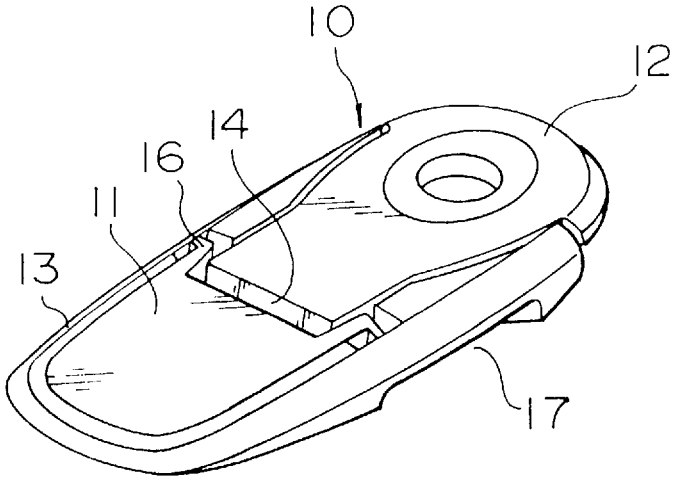
FIG. 7 is a diagram illustrating the external appearance of the pour opening unsealing device for a liquid container according to the present invention.

FIG. 6 is a diagram illustrating the structure of another pour opening unsealing device for a liquid container according to the present invention, with (a) being a front view, (b) being a plan view, (c) being a cross-sectional view taken along line 6(*c*)—6(*c*) and (*d*) being a right side view. FIG. 7 is a diagram illustrating the external appearance of the pour opening unsealing device. The same reference numerals as are used in FIGS. 1 through 5 are also used in FIGS. 6 and 7 to denote corresponding or identical components. The same applies to the other drawings.

A difference between a pour opening unsealing device 10 shown in FIGS. 6 and 7 and the pour opening unsealing device shown in FIG. 1, is that the pour opening unsealing device 10 in FIGS. 6 and 7 has a groove 17 in its bottom. Since the other portions have the same structures and functions as those of the device in FIG. 1, being shaped only slightly differently, a detailed explanation will not be given.

Figure 8:
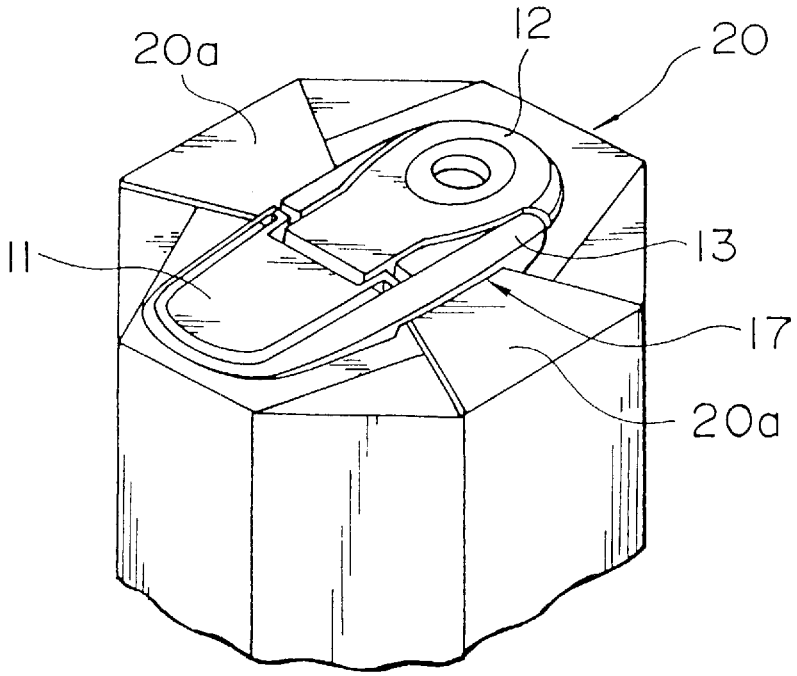
FIG. 8 is a diagram illustrating an external appearance when the pour opening unsealing device of the present invention is attached to the pour opening of a liquid container.

The above structured pour opening unsealing device 10 is attached to a pour opening (not shown) on the top of an octagonal liquid container 20, as is shown in FIG. 8. For this attachment, convex folded portions 20*a* of a package seal that runs across the pour opening atop the liquid container 20 fit into the groove 17. In this manner, the pour opening unsealing device 10 can be stably attached. More specifically, since the groove 17 is formed in the bottom of the pour opening unsealing device 10, the pour opening unsealing device 10 can be attached either to a flat or to a convex package seal portion, so that when the pour opening unsealing device 10 is attached its positioning is less restricted. In other words, an available area, on the top of the liquid container 20, for forming a pour opening can be extended.

As is shown in FIG. 8, the pour opening unsealing device 10 is so attached to the liquid container 20 that the unsealing portion 11 is located above the pour opening. For opening the container, a sealing member that is located on the lower surface of the unsealing portion 11 to seal the pour opening is torn by raising the actuating portion 12, and the pour opening is unsealed.

Figure 10A:
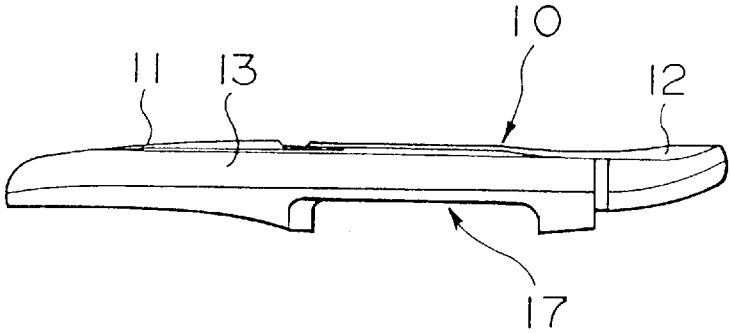
FIG. 10A is a plan view of the structure of an additional pour opening unsealing device for a liquid container according to the present invention, particularly a front view of the same.
Figure 10B:
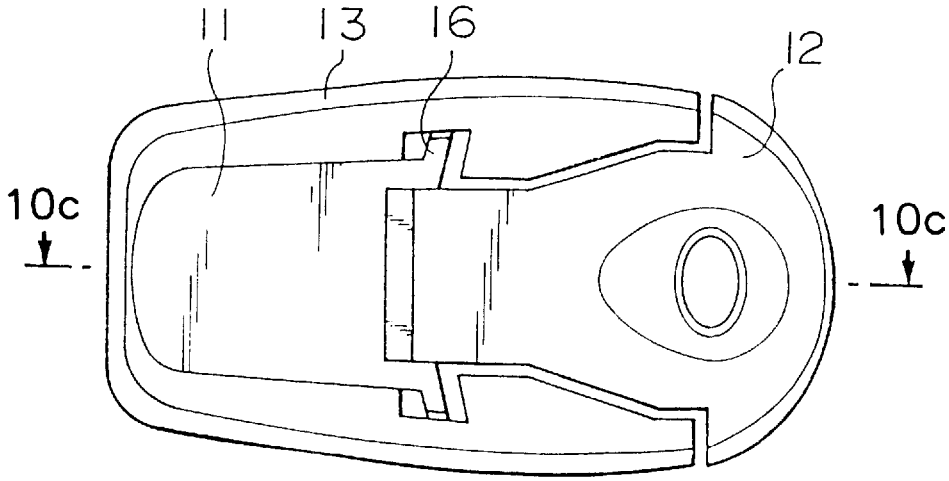
FIG. 10B is.
Figure 10C:
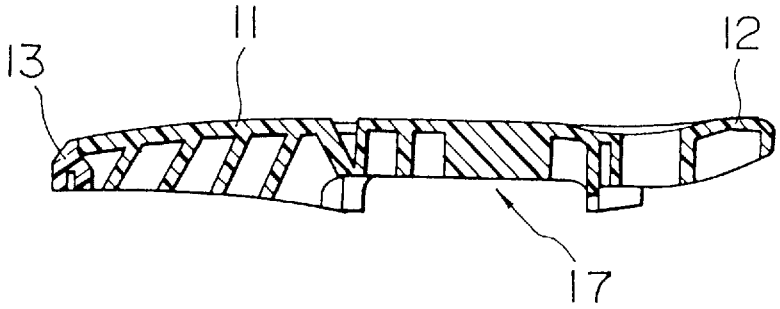
FIG 10C is a cross-sectional view taken along line 10(*c*)—10(*c*)
Figure 11:
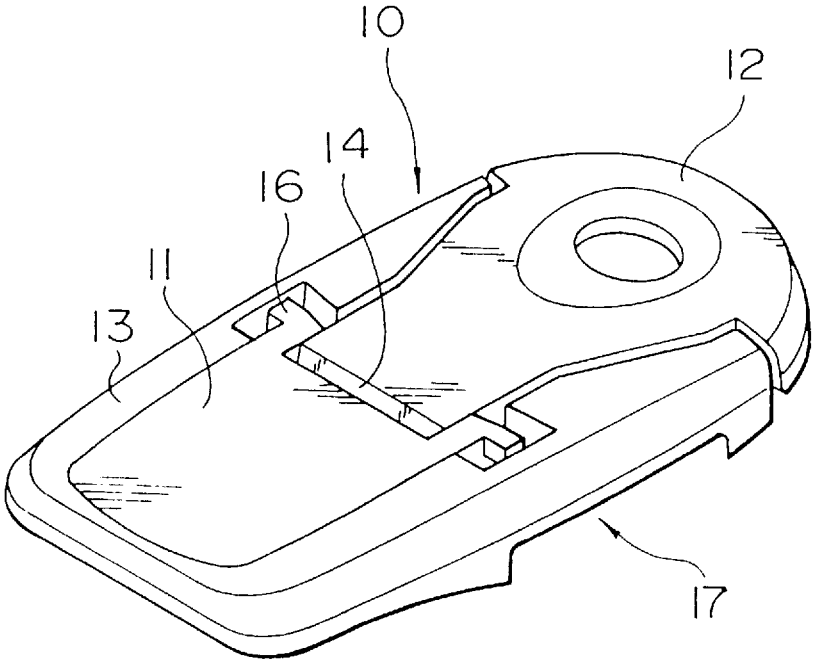
FIG. 11 is an external appearance illustrating the structure of the pour opening unsealing device for a liquid container according to the present invention.

FIG. 10 is a diagram illustrating the structure of an additional pour opening unsealing device for a liquid container according to the present invention, with (a) being a front view, (b) being a plan view, and (c) being a cross-sectional view taken along line 10(*c*)—10(*c*). FIG. 11 is a diagram illustrating the external appearance of the pour opening unsealing device. A difference between a pour opening unsealing device 10 shown in FIGS. 10 and 11 and the pour opening unsealing device shown in FIG. 1 is that a groove 17 is formed in the bottom of the pour opening unsealing device 10. The other portions have the same structure and the same functions, even though their shapes differ slightly.

Figure 9:
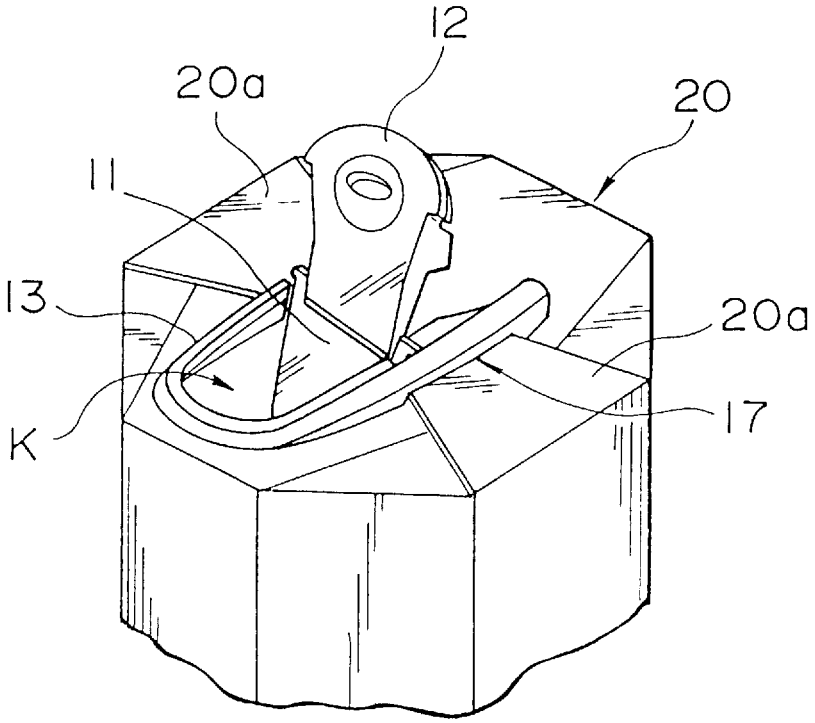
FIG. 9 is a diagram illustrating an external appearance when the pour opening unsealing device of the present invention has been opened.
Figure 12:
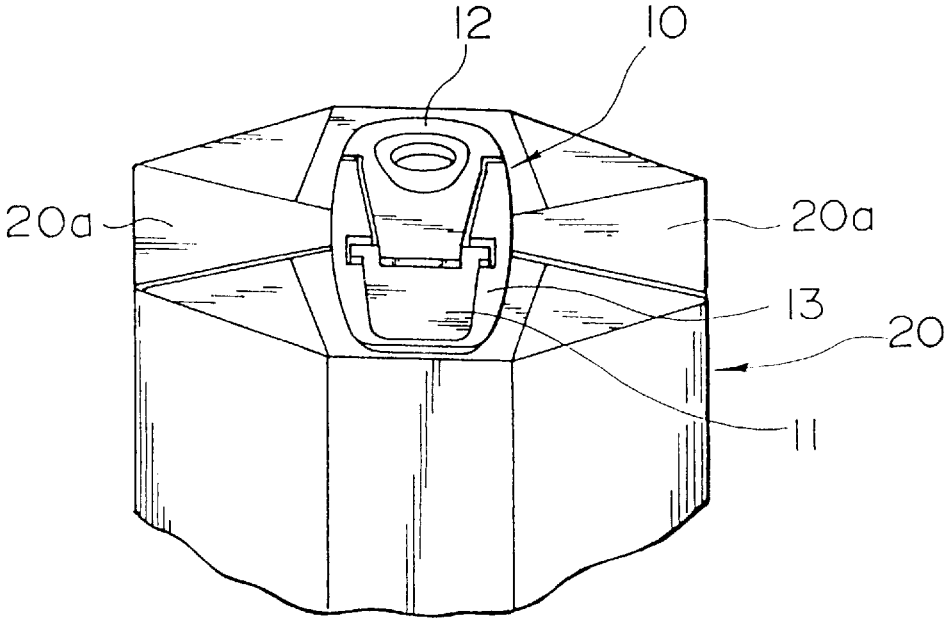
FIG. 12 is a diagram illustrating an external appearance when the pour opening unsealing device of the present invention is attached to the pour opening of a liquid container.

FIG. 12 is a diagram showing the condition where the pour opening unsealing device 10 has been attached to the pour opening on the top of an octagonal liquid container 20. Formed atop the octagonal liquid container 20 are convex folded package seal portions 20*a*. The pour opening unsealing device 10 is stably attached by fitting the convex folded portions 20*a* into the groove 17. Since the unsealing of the pour opening is performed in the same manner as was explained while referring to FIGS. 8 and 9, no explanation will be given here. As is described above, according to the present invention, simply by raising the end of the actuating portion 12 of the pour opening unsealing device 10, which is fixed to the liquid container 20 that is formed mainly of paper or a plastic material, the unsealing portion 11 that is connected to the actuating portion 12 is pivoted and tears a sealing member that is disposed on the lower side of the unsealing portion 11 and that seals the pour opening, thereby enabling the unsealing of the pour opening. Accordingly, there is no possibility of refuse being produced separately from the liquid container 20. Further, although before the pour opening is unsealed the engagement step 11*a* of the unsealing portion 11 engages the engagement step 13*a* of the support portion, these steps are disengaged simply by performing that part of the unsealing operation during which the actuating portion 12 is pulled up slightly. Therefore, whether or not someone has actuated the actuating portion 12 can be readily detected from the outside.

In addition, when the actuating portion 12 is returned to its previous position after the pour opening has been unsealed, the engagement pieces 16 that are provided on the unsealing portion 11 are held by the collar portions 13*b* of the support portion 13, thereby placing the unsealing portion 11 in a state wherein the pour opening is maintained unsealed. Therefore, once the pour opening is unsealed it will not be closed again.

Furthermore, since the groove 17 is formed in the bottom of the pour opening unsealing device 10, even when convex portions, such as sealed packaging portions or folded portions, are present at or near the pour opening of the liquid container 20, the pour opening unsealing device 10 can be stably attached to the liquid container 20 as long as the convex portions are appropriately shaped and sized so that they fit into the groove 17.

Industrial Usability of the Invention

As is described above, according to the present invention, provided is a pour opening unsealing device that is appropriate for the unsealing of a pour opening of a so-called non-resealable liquid container that once opened is not sealed again, and that is located over a sealing member, such as a film-shaped sheet, for covering and sealing the pour opening of a liquid container that is formed of packaging web made mainly of paper or plastic material.

What is claimed is:

1. A device, in combination with a liquid container, made of a resin material, for unsealing a pour opening of said liquid container, that is located atop a sealing member, which comprises a film-shaped sheet, for covering and sealing said pour opening of said liquid container that is formed of packaging web consisting essentially of at least one of paper and plastic material, and that opens said sealing member, comprising:

an unsealing portion for unsealing a sealing member, said sealing member is defined by a perimeter closing said pour opening.

an actuating portion for actuating said unsealing portion, and a support portion for so supporting said actuating portion that said pour opening unsealing device is secured to said liquid container, wherein said unsealing portion, said actuating portion and said support portion are generally disposed across the same plane;

wherein said unsealing portion and said actuating portion are connected at a lower portion of a V-shaped groove, which is formed between facing ends of said unsealing portion and said actuating portion, by a thin-walled portion;

wherein said support portion is positioned so as to encompass said unsealing portion and a predetermined portion of said actuating portion, which is a continuation of said unsealing portion;

wherein said actuating portion is supported by support bar members having a predetermined length, which are provided on both sides a specified distance from said V-shaped groove, and pivots at said support portion; and wherein when one end of said actuating portion that is farthest from said unsealing portion is raised, the other end of said actuating portion nearest said unsealing portion pivots around said support bar members, and accordingly, said unsealing portion is pivoted at said thin-walled portion to unseal said sealing member that is located under said unsealing portion.

2. A device for unsealing a pour opening, of a liquid container, according to claim 1, wherein an engagement step that is located at an end of said unsealing portion farthest from said actuating portion engages an engagement step of said support portion; wherein said support bar members are inclined at a specified angle downward relative to said unsealing portion; wherein when said end of said actuating portion that is farthest from said unsealing portion is raised, said end of said actuating portion nearest said unsealing portion pivots at said support bar members; wherein said engagement step of said unsealing portion is disengaged from said engagement step of said support member, and accordingly, said unsealing portion is pivoted at said thin-walled portion; and wherein, as a result, said sealing member that is positioned on a lower side of said unsealing portion is ripped off.

3. A device for unsealing a pour opening, of a liquid container, according to claim 1 or 2, wherein engagement pieces are formed on both sides at said end of said perimeter, respectively, each beginning at a point orthogonal to an axis defined by said v-shaped groove, at an end nearest to the actuating portion of said unsealing portion nearest said actuating portion; wherein when said unsealing portion is pivoted downward at said thin-walled portion, said engagement pieces engage collar portions on the side portions of said support member; and wherein when said actuating portion is returned to an original position, said engagement pieces hold said unsealing portion at said original position.

4. A device for unsealing a pour opening, of a liquid container, according to claim 1 or 2, wherein a recessed portion is formed in a bottom of said device, so that convex portions at and near said pour opening of said device are fitted into said recessed portion.

5. A device made of a resin material for unsealing a pour opening of a liquid container, located atop a sealing member comprising a film-shaped sheet, for covering and sealing the pour opening of the liquid container, that is formed of packaging web made mainly of at least one of paper and plastic material, which opens the sealing member, further comprising:

an unsealing portion for unsealing a sealing member having two facing sides defined by their location along a perimeter defining an area to be sealed;

an actuating portion for actuating said unsealing portion;

a support portion for supporting said actuating portion connected to said pour opening unsealing device which may be secured to a liquid container;

wherein said unsealing portion, said actuating portion and said support portion are generally disposed across the same plane;

wherein a v-shaped groove defines a border between a facing end of said unsealing portion and said actuating portion, and an opening portion and said actuating portion are joined at a lower portion of said v-shaped groove by a thin walled portion;

said support portion being positioned so as to encompass said unsealing portion and a predetermined portion of said actuating portion, which is contiguous with said unsealing portion;

wherein said actuating portion is supported by support bar members having a predetermined length, which support bar members are provided on both sides at a specified distance from said v-shaped groove, and pivot at said support portion;

wherein when one end of said actuating portion that is farthest from said unsealing portion is raised, the other end of said actuating portion nearest said unsealing portion pivots around said support bar members, and accordingly, said unsealing portion is pivoted at said thin walled portion to unseal said sealing member that is located under said unsealing member.

* * * * *